United States Patent [19]

Bosch et al.

[11] 3,941,864

[45] Mar. 2, 1976

[54] METHOD FOR MANUFACTURING MOLDED STRUCTURES AND COATINGS BASED ON INORGANIC BINDING AGENTS

[75] Inventors: Erhard Bosch; Ewald Pirson; Michael Roth, all of Burghausen, Germany

[73] Assignee: Wacker-Chemie GmbH, Munich, Germany

[22] Filed: May 28, 1974

[21] Appl. No.: 473,451

[30] Foreign Application Priority Data

June 4, 1973 Germany ..... 2328337

[52] U.S. Cl. ..... 264/256; 106/38.22; 427/133; 427/135

[51] Int. Cl.[2] ..... B28B 1/16

[58] Field of Search ..... 117/5.1, 5.3; 106/38.22; 427/133, 135; 264/255, 338, 256

[56] References Cited

UNITED STATES PATENTS

| | | | |
|---|---|---|---|
| 2,388,299 | 11/1945 | Thielemann | 117/5.1 |
| 2,507,200 | 5/1950 | Elliott | 117/135.5 |
| 2,666,685 | 1/1954 | Hommel et al. | 106/38.22 |
| 2,811,408 | 10/1957 | Braley | 117/5.1 |
| 3,035,318 | 5/1962 | Campbell | 117/5.3 |
| 3,047,917 | 8/1962 | McCarter et al. | 117/5.3 |
| 3,186,964 | 6/1965 | Kookootsedes et al. | 106/38.22 |
| 3,220,070 | 11/1965 | Tajkowski | 117/5.3 |
| 3,335,017 | 8/1967 | Spencer | 117/5.1 |
| 3,450,736 | 6/1969 | De Monterey | 106/38.22 |
| 3,554,910 | 1/1971 | Johnson | 117/5.3 |

FOREIGN PATENTS OR APPLICATIONS

| | | | |
|---|---|---|---|
| 481,025 | 1/1947 | Canada | 117/5.1 |
| 726,224 | 3/1955 | United Kingdom | 117/5.1 |
| 1,190,273 | 4/1970 | United Kingdom | 117/5.1 |

*Primary Examiner*—Harry J. Gwinell
*Assistant Examiner*—Dennis C. Konopacki

[57] ABSTRACT

A method of manufacturing molded structures and coatings based on curable inorganic binding agents and water which comprises coating shape-imparting surfaces made from materials such as wood, plaster, plastic or iron, with a mixture containing a curable organosilicon compound, a solvent and finely dispersed solid particles, such as silicon dioxide, quartz powder, diatomaceous earth and silicious chalk, applying the building materials, curing and removing the molded structures.

10 Claims, No Drawings

METHOD FOR MANUFACTURING MOLDED STRUCTURES AND COATINGS BASED ON INORGANIC BINDING AGENTS

The invention relates to molded structures, particularly molded structures having coatings which are hydrophobic. More particularly, the invention relates to a method for manufacturing molded structures by coating the shape-imparting mold surfaces with organosilicon compounds and thereafter adding the building materials based on inorganic binding agents to the coated surfaces.

Heretofore, the shape-imparting surfaces of molds were coated with organopolysiloxanes and cured prior to the molding of building materials based on inorganic binders such as concrete or gypsum. (See German Pat. No. 924,678; Austrian Pat. No. 210,041, and British Pat. No. 1,190,273.) Treatment of the shape-imparting mold surfaces with these organopolysiloxanes generally provided for easy release of the molded structures; however, the surfaces of the molded structures were not hydrophobic.

Although it was known that certain organosilicon compounds can be used to impart hydrophobic properties to building materials containing inorganic binding agents, these curable organosilicon compounds were generally mixed with the building materials prior to molding or applied directly to the surfaces of the finished molded structures or building material coatings. (See, for example, W. Noll "Chemie und Technologie der Silicone" Weinheim 1968, page 523 and ff or German Pat. No. 1,223,278.)

Compared to the conventional release agents such as mineral oil, tall oils, waxes or fatty acid salts (see "Ullmanns Encyklopadie der Technischen Chemie," 3rd edition, Munich-Berlin-Vienna, 1970, page 718), the method of this invention offers not only the advantage that it results in the production of molded structures and coatings having hydrophobic properties but also the surfaces of the molded structures and coatings produced therefrom are free of discoloration, spots or impurities, which often result when the above mentioned release agents are employed. Such discolorations, spots and impurities can generally be removed only with cleaning agents which may damage the molded structures and building material coatings.

Therefore it is an object of this invention to provide a method for manufacturing molded structures which are hydrophobic from building materials based on inorganic binding agents. Another object of this invention is to provide a method for manufacturing molded structures whose outer surfaces are free of discoloration, spots and impurities. Still another object of this invention is to provide a method for manufacturing molded structures which are easily removed from the mold surfaces. A further object of this invention is to provide a method for simultaneously imparting release properties and hydrophobic properties to the coatings and molded structures prepared from inorganic binding agents.

The foregoing objects and others which will become apparent from the following description are accomplished in accordance with this invention, generally speaking, by providing a method for manufacturing molded structures and coatings made of building materials based on inorganic binding agents which comprises adding the building materials to a mold whose shape-imparting surfaces have been coated with a mixture containing curable, hydrophobic inducing organosilicon compounds, finely dispersed solid inorganic materials and a solvent, if desired, and thereafter curing the building materials and the organosilicon compounds to impart hydrophobic properties to the molded structures.

It was totally unexpected that the method of this invention would provide for the easy release of the finished molded objects from the shape-imparting surfaces and at the same time impart hydrophobic properties to the shaped structures and the coatings based on inorganic binding agents. Thus, this invention obviates the necessity of treating the molded articles after their removal from the mold to impart hydrophobic properties thereto. In contrast to the release agents employed heretofore, such as mineral oils, tall oils, waxes or fatty acid salts which remain essentially unaltered while they are used, the curable organosilicon compounds undergo chemical changes while they cure and even while they are in contact with simultaneously hardening building materials. This is why the lubricating properties which were essential in the release agents employed heretofore cannot be attributed to the organosilicon compounds or their derivatives employed in accordance with this invention. Another advantage of this invention is that it is no longer necessary to cure the organosilicon compounds before they are placed in contact with the building materials to be hardened. Heretofore it was essential that the organosilicon compounds be cured before the addition of the building materials in order to provide a smooth surface thereby providing for the release of the molded structures. Finally, it would be expected that the cured organosilicon compounds would, like alkali metal organosiliconate dyes (see German Pat. No. 1,285,652) be anchored to the shape-imparting surfaces, and therefore would be unable to impart hydrophobic properties to the shaped structures or coatings based on inorganic binding agents.

Any building material containing inorganic binding agents may be used in this invention. These building materials are mixed with water prior to molding and then allowed to harden. Generally, curing occurs without an external supply of heat, i.e., at ambient temperature. However, if desired, e.g., during the manufacture of finished concrete components, heat may be applied in order to accelerate the curing process. The most important examples of such building materials are the conventional mixtures of commercial cement, such as Portland cement, siderurgical cement, blastfurnace cement, natural cement or mixtures of such cement types and additives such as sand, silica, and/or lime. An additional example of such building materials is gypsum.

Examples of shape-imparting surfaces are molds whose surfaces are made of wood, plaster, plastic or iron.

Any organosilicon compounds which are curable and will impart water repellency may be used in this invention. The organosilicon compounds contain condensable atoms such as Si-bonded hydrogen atoms, and/or condensable or hydrolyzable groups such as Si-bonded hydroxyl, alkoxy or alkali metal oxy groups. In order to provide hydrophobic properties it is essential that they contain Si-bonded organic radicals, preferably a preponderance of hydrocarbon or halogenated hydrocarbon radicals.

Examples of suitable compounds are organohydroxypolysiloxanes, especially methylhydroxypolysiloxanes and organopolysiloxanes which contain more than 10 silicon atoms per molecule and have units of the general formula $$R_xSi(OR')_y(OH)_zO \quad \frac{4-x-y-z}{2}$$

in which R represents a monovalent hydrocarbon radical or a halogenated monovalent hydrocarbon radical having from 1 to 14 carbon atoms, R′ is an alkyl radical having from 1 to 5 carbon atoms; $x$, $y$ and $z$ are numbers of from 0 to 3, the sum of $x+y+z$ is no more than 3, with the mean value of $x$ being from 0.9 to 1.7, preferably 0.9 to 1.3, the mean value of $y$ being from 0.01 to 0.20 and the mean value of $z$ is from 0.00 to 0.20. It is preferred that the organopolysiloxanes represented by the above general formula do not contain more than about 30 mol percent of units in which $x$ is 2 or 3, and the viscosity of such organopolysiloxanes in a 50 percent by weight toluene solution is a maximum of 1000 cSt at 25°C.

Because they provide good release properties and because they result in a particularly high degree of water repellency, organoalkoxysilanes of the following general formula are preferred $$R_{4-m}Si(OR')_m$$

where R and R′ are the same as above and $m$ is 1, 2 or 3; and the partial hydrolysates of said silanes provided that they contain no more than about 10 silicon atoms per molecule, as well as the alkali metal hydrocarbon siliconates in which the hydrocarbon radicals are alkyl radicals of from 1 to 5 carbon atoms or the phenyl radical.

Examples of suitable monovalent hydrocarbon radicals are alkyl radicals such as methyl, ethyl, n-propyl, isopropyl, hexyl, octyl, decyl, tetradecyl radicals and halogenated derivatives thereof. An example of a halogenated monovalent radical is the α- α- α-trifluoropropyl radical. An example of an aryl radical R is the phenyl radical and a halogenated aryl radical is the p-chlorophenyl radical.

Examples of suitable alkyl radicals represented by R′ are methyl, ethyl, n-propyl, isopropyl and n-butyl radicals.

Most of the building materials based on inorganic binding agents which are allowed to cure in contact with the molding surfaces contain free lime until they are thoroughly cured. Since propyl silicon compounds are particularly stable with respect to the action of free lime, organosilicon compounds which impart hydrophobic properties to the molded structures are preferably those which correspond to the formula $$(n\text{-}C_3H_7)_{4-m}Si(OR')_m$$

where R′ and m are the same as above, as well as the partial hydrolysates thereof which contain no more than 10 silicon atoms per molecule. Other organosilicon compounds are alkali propylsiliconates, i.e., monomer compounds of the formula $$N\text{-}C_3H_7\,Si\,(OH)_2OMe$$

and/or polymeric compounds having units of the formula $$n\text{-}C_3H_7SiO(OMe)$$

where Me is always an alkali metal atom, particularly sodium or potassium.

The finely dispersed particles of inorganic compounds which are used in this invention together with the curable organosilicon compounds, are preferably colorless in order to avoid discoloration of the molded structures or coatings produced in accordance with the invention. It is preferable that the fine particles of solid inorganic compounds have a surface area of at least 10 $m^2/g$. and more preferably at least 50 $m^2/g$, but no more than about 400 $m^2/g$.

Preferred examples of finely dispersed particles of inorganic compounds are finely dispersed silicon dioxides of synthetic or natural origin such as pyrogenically produced silicon dioxide, silicon dioxide-aerogels, i.e., silicic acid hydrogels which have been dehydrated while maintaining the structure, precipitated silicon dioxide, including precipitated silicon dioxide with a surface area of at least 50 $m^2/g$, quartz powder, diatomaceous earth and so-called siliceous chalk. Additional examples of finely dispersed inorganic substances are talcum powder which has a surface area of at least 10 $m^2/g$, calcium silicate, calcium carbonate, mica or zirconium silicate, as well as asbestos powder.

The amount of finely dispersed inorganic compounds is preferably from 5 to 40 percent by weight based on the total weight of the mixture containing the curable organosilicon compound, the finely dispersed particles of inorganic compound and solvent, if desired. The greater the surface area of the finely dispersed inorganic compounds, the less that will be required.

If finely dispersed inorganic compounds are not employed, removal of the molded structures from the mold is more difficult and it is often impossible to obtain molded structures or building material coatings based on inorganic binding agents having a water repellent surface which is free of spots.

In order to facilitate a uniform distribution on the shape-imparting surfaces, the mixtures which contain a finely dispersed inorganic compound and the curable organosilicon compounds may be combined with a solvent to form a paste or a liquid dispersion.

If the curable organosilicon compounds are water soluble such as alkali metal organosilicates, then water may of course be employed as a solvent. Examples of organic solvents which may be used are hydrocarbons such as toluene, xylene and trimethylbenzene; halogenated hydrocarbons such as trichloroethylene; ethers such as n-butyl ether; alcohols such as ethanol and isopropanol; as well as ketones, such as methylethyl ketone. Preferably these solutions contain from 5 to 50 percent by weight of the organosilicon compounds based on the total weight of all components of the solutions, including the suspended fine particles of solid inorganic compounds.

The mixture containing organosilicon compounds, finely dispersed particles of solid inorganic compounds and solvent, if desired, may be applied to the shape-imparting surfaces by means of brushing, spraying, dipping or via application with a putty knife.

Preferably the mixture containing organosilicon compounds, finely dispersed particles of solid inorganic substances and solvent should be applied in amounts of from 0.2 to 1 $kg/m^2$ of mold surface area.

In preparing the molded structures, the building materials are added to the mold surfaces containing an uncured coating of a composition containing an organosilicon compound, finely dispersed particles of solid inorganic substances and solvent, if desired. If the coating is allowed to cure before the building materials are added to the mold surfaces, the molded structures and coatings are not rendered water-repellent. Thus, it is essential that the building material be applied to the coated surfaces while the coating is in an uncured condition. In order to prevent premature curing of the coating, curing catalysts are omitted from the mixture containing organosilicon compounds, finely dispersed particles of inorganic substances and solvent, if desired. Moreover, these coating compositions containing the organosilicon compounds, finely dispersed particles of inorganic substances and solvent, if desired, should not be applied to the mold surfaces more than 10 days, preferably not more than 24 hours and more preferably not more than 10 hours prior to the addition of the building materials to be molded. The coatings should be maintained at ambient temperature prior to the addition of the building materials.

The building materials to be molded may be placed in contact with the coatings which have been obtained via the application of mixtures of organosilicon compounds, finely dispersed particles of inorganic substances as well as solvents, if desired, by any conventional technique known in the art, such as, for example, by pouring. By the same token, the finished structures or coatings made from building materials based on inorganic binding agents, can be removed from the molds by any means known in the art.

In the following examples, parts and percentages are by weight unless otherwise specified.

EXAMPLE 1

On the inside walls of an iron mold having inside dimensions of 4 × 4 × 16 cm is applied a coating of mixture (A) which consists of 10 parts n-propyltriethoxysilane, 10 parts pyrogenically produced silicon dioxide having a surface area of approximately 300 $m^2/g$ and 100 parts of isopropanol at the rate of approximately 0.3 $kg/m^2$. Immediately thereafter a mixture consisting of 1 bag of standard sand (1350 parts), 450 parts of white cement PZ 450 F and 225 parts water (prepared in accordance with DIN 1164, June 1970) is placed in said form and condensed. After 4 days the thus-formed prismatic concrete shape is removed from the form.

EXAMPLE 2

The procedure described in Example 1 is repeated except that mixture (B) which contains 10 parts of an aqueous solution of potassium propylsiliconate having a 20 percent siliconate concentration which is calculated as $n\text{-}C_3H_7SiO_{3/2}$, 15 parts of pyrogenically produced silicon dioxide having a surface of approximately 300 $m^2/g$ and 30 parts of water, is substituted for mixture (A).

COMPARISON EXAMPLE A

The procedure described in Example 1 is repeated except that the mold surfaces are not treated prior to the addition of the cement mixture.

COMPARISON EXAMPLE B

The procedure described in Example 1 is repeated except that a commercially available release agent containing a 10 percent solution of tall oil in alkylbenzenes, mostly dodecylbenzene is substituted for mixture (A).

The results of these examples are illustrated in the following table.

TABLE

| | Ease of removal from mold | Appearance of molded structures after removal | Water repellency |
|---|---|---|---|
| Example 1 | very good | free of spots on all sides and light, remarkably few air pores and craters | not wetted by sprayed water |
| Example 2 | very good | light and smooth on all sides | is wetted by sprayed water only superficially, does not darken, water is not absorbed |
| Comparison Example A | adheres to mold | surface partially damaged by adhesion to mold | sprayed on water irregularly absorbed |
| Comparison Example B | good | partly dark, partly light | sprayed water is irregularly absorbed by entire surface, spots formed |

Although specific examples of the invention have been described herein, it is not intended to limit the invention solely thereto but to include all the variations and modifications falling within the scope of the appended claims.

What is claimed is:

1. A method for manufacturing molded structures and coatings from building materials based on inorganic binding agents and water which comprises coating the shape-imparting surface of a mold with a composition consisting essentially of a mixture of a curable organosilicon compound capable of imparting water repellency to the molded structures, a solvent and finely dispersed particles of an inorganic material having a surface area of from 10 to 400$m^2/g$ in an amount from 5 to 40% by weight based on the total weight of the mixture and applying to the uncured coating the building materials which are capable of curing to a solid, curing the materials and thereafter removing the molded structure.

2. The method of claim 1 wherein the solvent is an organic solvent.

3. The method of claim 2 wherein the organosilicon compound is present in an amount of 5 to 50 percent by weight based on the total weight of the mixture. 5

4. The method of claim 1 wherein the organosilicon compound contains units of the general formula $$R_xSi(OR')_y(OH)_zO \quad \frac{4-x-y-z}{2}$$

in which R is selected from the group consisting of monovalent hydrocarbon radicals and halogenated monovalent hydrocarbon radicals having from 1 to 14 carbon atoms, R′ is an alkyl radical having from 1 to 5 carbon atoms, $x$, $y$ and $z$ are each numbers of from 0 to 3, and the sum of $x+y+z$ is no greater than 3.

5. The method of claim 1 wherein the organosilicon compound is represented by the general formula $$R_{4-m}Si(OR')_m$$

in which R is selected from the group consisting of monovalent hydrocarbon radicals and halogenated monovalent hydrocarbon radicals having from 1 to 14 carbon atoms, R′ is an alkyl radical having from 1 to 5 carbon atoms and $m$ is a number of from 1 to 3.

6. The method of claim 5 wherein the organosilicon compound is represented by the formula $(n\text{-}C_3H_7)_{4-m}Si(OR')_m$ in which R′ is an alkyl radical having from 1 to 5 carbon atoms and $m$ is a number of from 1 to 3.

7. The method of claim 1 wherein the organosilicon compound is represented by the general formula $n\text{-}C_3H_7Si(OH)_2OMe$ in which Me is an alkali metal.

8. The method of claim 7 wherein the organosilicon compound is an alkali metal propylsiliconate.

9. The method of claim 1 wherein the finely dispersed inorganic material is silicon dioxide.

10. The method of claim 1 wherein the coating is applied in an amount of from 0.2 to 1 kg/m$^2$ of mold surface area.

* * * * *